US009612542B2

(12) United States Patent
Takamiya et al.

(10) Patent No.: US 9,612,542 B2
(45) Date of Patent: Apr. 4, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Yuki Takamiya, Kanagawa (JP); Yuka Kawamoto, Kanagawa (JP); Daisuke Ishizuka, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/507,441

(22) Filed: Oct. 6, 2014

(65) Prior Publication Data

US 2015/0370187 A1 Dec. 24, 2015

(30) Foreign Application Priority Data

Jun. 18, 2014 (JP) ..... 2014-125455

(51) Int. Cl.

| | |
|---|---|
| ***G03G 9/097*** | (2006.01) |
| ***G03G 9/087*** | (2006.01) |
| ***G03G 9/08*** | (2006.01) |
| ***G03G 9/113*** | (2006.01) |

(52) U.S. Cl.

CPC ..... *G03G 9/08755* (2013.01); *G03G 9/0819* (2013.01); *G03G 9/0827* (2013.01); *G03G 9/08782* (2013.01); *G03G 9/08795* (2013.01); *G03G 9/08797* (2013.01); *G03G 9/1132* (2013.01); *G03G 9/1139* (2013.01)

(58) Field of Classification Search

CPC ..... G03G 9/09733

See application file for complete search history.

(56) References Cited

U.S. PATENT DOCUMENTS

| | | | | |
|---|---|---|---|---|
| 5,126,224 | A * | 6/1992 | Hyosu | G03G 9/08706 430/109.3 |
| 5,447,813 | A | 9/1995 | Hagiwara et al. | |
| 5,807,654 | A | 9/1998 | Kubo et al. | |
| 6,103,438 | A | 8/2000 | Kubo et al. | |
| 6,495,648 | B1 * | 12/2002 | Inagaki | G03G 9/08711 428/402 |
| 2010/0316944 | A1 * | 12/2010 | Nakajima | G03G 9/0804 430/105 |

FOREIGN PATENT DOCUMENTS

| | | |
|---|---|---|
| JP | A-7-49588 | 2/1995 |
| JP | A-8-253562 | 10/1996 |
| JP | A-2002-82472 | 3/2002 |
| JP | A-2004-78258 | 3/2004 |
| JP | A-2007-139811 | 6/2007 |

* cited by examiner

*Primary Examiner* — Hoa V Le
(74) *Attorney, Agent, or Firm* — Oliff PLC

(57) ABSTRACT

An electrostatic charge image developing toner includes a binder resin containing a polyester resin, a release agent, a colorant, and an aromatic aldehyde compound, the content of which exceeds 100 ppm and is equal to or smaller than 1200 ppm.

15 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2014-125455 filed Jun. 18, 2014.

BACKGROUND

1. Technical Field

The present invention relates to electrostatic charge image developing toner, an electrostatic charge image developer, and a toner cartridge.

2. Related Art

Various kinds of electrostatic charge image developing toner used in an electrophotographic image forming apparatus have been proposed.

SUMMARY

According to an aspect of the invention, there is provided an electrostatic charge image developing toner including:

a binder resin containing a polyester resin;

a release agent;

a colorant; and an aromatic aldehyde compound, the content of which exceeds 100 ppm and is equal to or smaller than 1200 ppm.

BRIEF DESCRIPTION OF THE DRAWINGS

Exemplary embodiments of the present invention will be described in detail based on the following figures, wherein.

DETAILED DESCRIPTION

Figure 1:
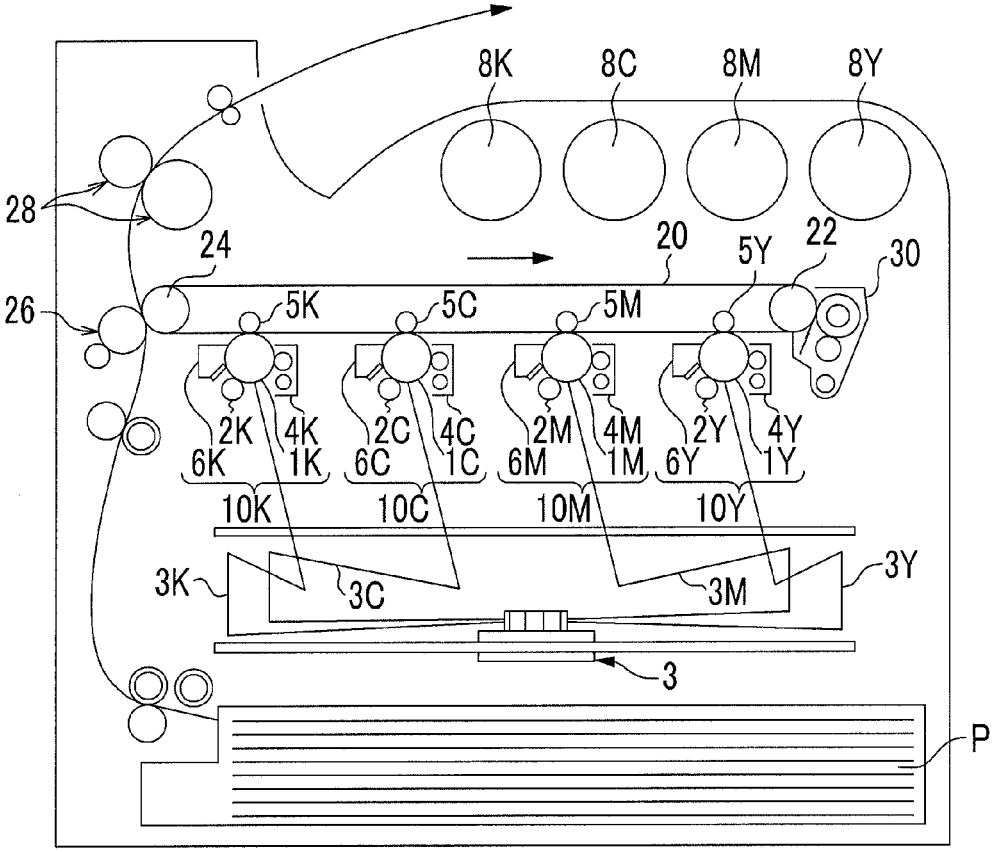
FIG. 1 is a schematic configuration diagram showing an example of an image forming apparatus according to this exemplary embodiment.

Hereinafter, exemplary embodiments which are examples of the invention will be described in detail.

Electrostatic Charge Image Developing Toner Electrostatic charge image developing toner according to this exemplary embodiment (hereinafter, referred to as "toner") includes a toner particle containing a binder resin containing a polyester resin, a release agent, a colorant, and an aromatic aldehyde compound, the content of which exceeds 100 ppm and is equal to or smaller than 1200 ppm.

Herein, the aromatic aldehyde compound is a compound in which a hydrogen atom on an aromatic ring is substituted with a substituent including an aldehyde group.

On the aromatic ring, a hydrogen atom which is not substituted with the substituent including an aldehyde group may be substituted with a substituent other than the substituent including an aldehyde group.

With the configuration described above, the toner according to this exemplary embodiment prevents deterioration of anti-crease performance of a halftone image after being kept (for example, for 20 days) in an environment of high humidity (for example, equal to or higher than 80% RH) and high light intensity (for example, 1 $KW/m^2$). The reason thereof is not clear and the considered reasons are as follows.

Since the polyester resin contained in the toner has an ester bond easily hydrolyzable, hydrolysis easily occurs in an environment of high humidity. In addition, deterioration of the polyester resin due to photooxidation easily occurs in an environment of high light intensity. Particularly, when a polymerizable monomer configuring the polyester resin includes an aromatic ring, the ester bond of the polyester resin may exist adjacent to the aromatic ring. This aromatic ring is activated by absorbing light (for example, ultraviolet light) in the environment of high light intensity, and an electronic state thereof is easily set to a high energy state. Accordingly, deterioration of the ester bond adjacent to the aromatic ring due to oxidation easily occurs, due to an electron in the high energy state and oxygen in the atmosphere.

The halftone image having low image density has a large surface area of the toner in the image which comes in contact with the atmosphere, and is easily exposed to the environment of high humidity and high light intensity. Accordingly, when the halftone image is kept in the environment of high humidity and high light intensity for a long time, the polyester resin in the toner is easily deteriorated, and as a result, anti-crease performance of the halftone image may be deteriorated.

Meanwhile, since the aldehyde group is a polar group, the aldehyde group has a property to be easily hydrated. Accordingly, when the polyester resin and the aromatic aldehyde compound are contained in an amount in the specified range, a site of the ester bond is protected due to a hydration property of the aldehyde group. Therefore, the hydrolysis of the polyester resin may be prevented. In addition, with the aromatic aldehyde compound, the aromatic ring in the structure does not only easily absorb the light, but also moves the energy from the aromatic ring in the high energy state, and therefore, an antioxidation action may occur and photooxidation may be prevented.

With the actions of the aromatic aldehyde compound, deterioration of the polyester resin contained in the toner of the halftone image may be prevented, and as a result, deterioration of anti-crease performance of the halftone image may be prevented.

It is preferable to use a compound having a structure in which an aromatic ring is substituted with an aldehyde group, among the aromatic aldehyde compounds, because an action of moving the energy from the aromatic ring in the high energy state is more efficiently performed. Particularly, when using benzaldehyde, benzaldehyde may exist in a position closer to the ester bond due to a small bulk, and more efficient antioxidation action may be performed.

Hereinafter, a configuration of the toner according to this exemplary embodiment will be described in detail.

The toner according to this exemplary embodiment includes a toner particle, and if necessary, an external additive.

Toner Particle

The toner particle according to this exemplary embodiment contains the binder resin containing the polyester resin, the colorant, the release agent, the aromatic aldehyde compound, and if necessary, other additives.

Binder Resin

The binder resin according to this exemplary embodiment contains the polyester resin. As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent alcohol employing a crosslinked structure or a branched structure may be used in combination together with a diol. Examples of the tri- or higher-valent alcohol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is acquired by a DSC curve obtained by differential scanning calorimetry (DSC). More specifically, the glass transition temperature is acquired by "extrapolation glass transition starting temperature" disclosed in a method of acquiring the glass transition temperature of JIS K7121-1987 "Testing Methods for Transition Temperature of Plastics".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using HLC-8120 GPC which is a GPC manufactured by Tosoh Corporation as a measurement device and column TSKgel Super HM-M (15 cm) manufactured by Tosoh Corporation. The weight average molecular weight and the number average molecular weight are calculated using a calibration curve of molecular weight created with a monodisperse polystyrene standard sample from results of this measurement.

The polyester resin is obtained with a well-known manufacturing method. Specific examples thereof include a method of conducting a reaction at a polymerization temperature set to 180° C. to 230° C., if necessary, under reduced pressure in the reaction system, while removing water or alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

As the polyester resin, an amorphous polyester resin and a crystalline polyester resin can be used singly or in combination with each other.

Examples of the amorphous polyester resin include polycondensates of polyvalent carboxylic acids and polyols. A commercially available product or a synthesized product may be used as the amorphous polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and more preferably from 50° C. to 65° C.

A weight average molecular weight (Mw) of the amorphous polyester resin is preferably from 5,000 to 1,000,000, and more preferably from 7,000 to 500,000.

A number average molecular weight (Mn) of the amorphous polyester resin is preferably from 2,000 to 100,000.

Molecular weight distribution Mw/Mn of the amorphous polyester resin is preferably from 1.5 to 100, and more preferably from 2 to 60.

The amorphous polyester resin is manufactured with a well-known manufacturing method. Specific examples thereof include a method of conducting a reaction at a polymerization temperature set to 180° C. to 230° C., if necessary, under reduced pressure in the reaction system, while removing water or alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with the major component.

Examples of the crystalline polyester resin include polycondensates of polyvalent carboxylic acids and polyols. A commercially available product or a synthesized product may be used as the crystalline polyester resin.

Herein, as the crystalline polyester resin, a polycondensate using a polymerizable monomer having a linear aliphatic group is preferably used rather than a polymerizable monomer having an aromatic group, in order to easily form a crystal structure.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, naphthalene-2,6-dicarboxylic acid, malonic acid, and mesaconic acid), anhydrides thereof, or lower alkyl esters (having, for example, from 1 to 5 carbon atoms) thereof.

As the polyvalent carboxylic acid, a tri- or higher-valent carboxylic acid employing a crosslinked structure or a branched structure may be used in combination together with a dicarboxylic acid. Examples of the trivalent carboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, or lower alkyl esters (having, for example, from 1 to 5 Carbon atoms) thereof.

As the polyvalent carboxylic acid, a dicarboxylic acid having a sulfonic acid group or a dicarboxylic acid having an ethylenic double bond may be used in combination together with these dicarboxylic acids.

The polyvalent carboxylic acids may be used alone or in combination of two or more kinds thereof.

Examples of the polyol include aliphatic diols (e.g., linear aliphatic diols having 7 to 20 carbon atoms in a main chain part). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferably used as the aliphatic diol.

As the polyol, a tri- or higher-valent polyol employing a crosslinked structure or a branched structure may be used in combination together with a diol. Examples of the tri- or higher-valent polyol include glycerin, trimethylolethane, trimethylolpropane, and pentaerythritol.

The polyols may be used alone or in combination of two or more kinds thereof.

Here, in the polyol, the content of the aliphatic diol may be 80% by mol or greater, and preferably 90% by mol or greater.

The melting temperature of the crystalline polyester resin is preferably from 50° C. to 100° C., more preferably from 55° C. to 90° C., and even more preferably from 60° C. to 85° C.

The melting temperature is obtained from "melting peak temperature" described in the method of obtaining a melting temperature in JIS K7121-1987 "testing methods for transition temperatures of plastics", from a DSC curve obtained by differential scanning calorimetry (DSC).

The weight average molecular weight (Mw) of the crystalline polyester resin is preferably from 6,000 to 35,000.

For example, a known manufacturing method is used to manufacture the crystalline polyester resin as in the case of the amorphous polyester resin.

The binder resin may contain other resins than the polyester resins described above. However, when containing other resins, the content of the polyester resin may be equal to or greater than 50% by weight (preferably equal to or greater than 60% by weight and even more preferably equal to or greater than 70% by weight) with respect to entire binder resin, from a viewpoint of fixability.

Examples of other resins include a styrene acrylic resin, a vinyl resin other than a styrene acrylic resin, an epoxy resin, a polyurethane resin, a polyamide resin, a cellulose resin, a polyether resin, and a non-vinyl resin.

The content of the binder resin is, for example, preferably from 40% by weight to 95% by weight, more preferably from 50% by weight to 90% by weight, and even more preferably from 60% by weight to 85% by weight, with respect to the entire toner particle.

Aromatic Aldehyde Compound

As described above, the aromatic aldehyde compound of this exemplary embodiment is a compound substituted with a substituent including an aldehyde group on the aromatic ring.

The aromatic ring is not particularly limited as long as it has a ring structure having a conjugated double bond. Preferable examples of the aromatic ring include monocycles such as a benzene ring, a naphthalene ring, a phenanthrene ring, a furan ring, a thiophene ring, a pyrrole ring, a pyridine ring, or a polycyclic aromatic ring, in order to prevent a decrease in brittleness of an image.

The substituent including an aldehyde group may be the aldehyde group as it is, or may be a substituent in which an aldehyde group is bonded with saturated or unsaturated hydrocarbon (for example, hydrocarbon having 1 to 6 carbon atoms).

In addition, the aromatic aldehyde compound may be substituted with a substituent other than the substituent including an aldehyde group. Examples of this substituent include an alkyl group (an unsubstituted alkyl group or a halogen-substituted alkyl group), an alkenyl group (an unsubstituted alkenyl group or a halogen-substituted alkenyl group), an alkoxy group, and a halogen group.

Specific examples of the aromatic aldehyde compound include benzaldehyde, 2-methoxy benzaldehyde, 3-methoxy benzaldehyde, 2-ethoxy benzaldehyde, 4-ethoxy benzaldehyde, 4-butoxy benzaldehyde, p-(2-hydroxyethoxy) benzaldehyde, 3,4-dihydroxy-5-methoxy benzaldehyde, 2-methyl-4-benzyloxybenzaldehyde, p-chlorobenzaldehyde, 3,5-dichloro benzaldehyde, 2-bromo-5-(trifluoromethyl) benzaldehyde, 2,3,6-trifluorobenzaldehyde, 2-chloro-6-fluoro-3-methylbenzaldehyde, m-(trifluoromethyl) benzaldehyde, 2-fluoro-5-methoxybenzaldehyde, 4-methoxy-2-(trifluoromethyl) benzaldehyde, 3-thiophen-2-yl-benzaldehyde, 2-phenyl propanal, 3-phenyl propanal, 2-(4-methylphenyl) propanal, 2-(4-isopropyl phenyl) propanal, 3-(3,4-methylenedioxyphenyl)-2-methyl propanal, 2-methyl-3-(4-methylphenyl) propanal, 2-methyl-3-(4-tert-butylphenyl) propanal, 2-phenyl-2-butenal, 2-phenyl-4-pentenal, 3-phenyl-4-pentenal, 3-(2-furyl)-2-propenal, 3-(2-furyl)-2-isopropyl-2-propenal, 2-methyl-4-phenylbutanal, 3-(4-ethylphenyl)-2,2-dimethylpropanal, 3-(2-furyl)-2-methyl-2-propenal, 3-(2-furyl)-2-phenyl-2-propenal, 5-(2-furyl)-2,4-pentadienal, 3-(5-methyl-2-furyl) butanal, 5-methyl-2-phenyl-2-hexenal, 4-methyl-2-phenyl-2-hexenal, and 4-methyl-2-phenyl-2-pentenal, and there is no particular limitation.

Among these, a compound substituted with a substituent including an aldehyde group on a benzene ring is preferable, and benzaldehyde is particularly preferably used, in order to prevent the deterioration of anti-crease performance of the halftone image.

A commercially available product or a synthesized product may be used as the aromatic aldehyde compound.

The content of the aromatic aldehyde compound exceeds 100 ppm and is equal to or smaller than 1200 ppm with respect to the toner particle. When the content thereof is in the range described above, the deterioration of anti-crease performance of the halftone image is prevented. The content thereof is preferably from 150 ppm to 600 ppm and more preferably from 180 ppm to 400 ppm. The content is based on weight.

The content of the aromatic aldehyde compound with respect to the toner particle is measured as follows. That is, the toner particle which is a measurement target is analyzed with a gas chromatography (GC-2010 manufactured by Shimadzu Corporation), and an amount of the aromatic aldehyde compound in the toner particle is quantized. When the measurement of the aromatic aldehyde compound is singly performed before the analysis, a unique retention time of a sample is measured, and a calibration curve is created, the quantification can be performed. The measurement conditions are as follows.

Apparatus: GC: GC-2010 manufactured by Shimadzu Corporation

HS: HS40 Turbomatrix manufactured by PerkinElmer

Separation column: Rtx-1

Column heating condition: 10° C./min (40° C.→250° C.)

Headspace condition: heat to 130° C. for 3 minutes

Temperature of vaporizing chamber: 220° C.

Temperature of detector: 260° C.

Carrier gas: $N_2$

Toner amount: 0.5 g

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate, and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used alone or in combination of two or more kinds thereof.

If necessary, the colorant may be surface-treated or used in combination with a dispersing agent. Plural kinds of colorants may be used in combination thereof.

The content of the colorant is, for example, preferably from 1% by weight to 30% by weight, and more preferably from 3% by weight to 15% by weight with respect to the entirety of the toner particles.

Release Agent

Examples of the release agent include hydrocarbon-based waxes; natural waxes such as carnauba wax, rice wax, and candelilla wax; synthetic or mineral/petroleum-based waxes such as montan wax; and ester-based waxes such as fatty acid esters and montanic acid esters. The release agent is not limited thereto.

As the release agent, it is preferable to use plural kinds of the hydrocarbon-based release agent. This is because, by using plural kinds of release agent originally having low affinity, unevenness of the release agent spreading on the surface of the image can be prevented as much as possible, by increasing the amount of the release agent, the contact of the resin on the surface of the image and oxygen can be reduced to prevent oxidation, and by decreasing a melting temperature of the release agent, diffusion and decomposition of the aromatic aldehyde due to heating can be prevented.

The melting temperature of the release agent is preferably from 50° C. to 110° C., and more preferably from 60° C. to 100° C.

The melting temperature of the release agent is obtained from "melting peak temperature" described in the method of obtaining a melting temperature in JIS K7121-1987 "Testing methods for transition temperatures of plastics", from a DSC curve obtained by differential scanning calorimetry (DSC).

The content of the release agent is, for example, preferably from 1% by weight to 20% by weight and more preferably from 5% by weight to 15% by weight, with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, toner particles having a core/shell structure are preferably composed of, for example, a core containing a binder resin, and if necessary, other additives such as a colorant and a release agent, and a coating layer containing a binder resin.

The volume average particle diameter (D50v) of the toner particles is preferably from 2 μm to 10 μm, and more preferably from 4 μm to 8 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a cumulative number average particle diameter D50p. Furthermore, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

The shape factor SF1 of the toner particles is preferably from 110 to 150, and more preferably from 120 to 140.

The shape factor SF1 is obtained through the following expression.

Expression: $SF1=(ML^2/A)\times(\pi/4)\times100$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic (SEM) image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, PMMA (polymethyl methacrylate), and melamine resin particles) and a cleaning activator (e.g., metal salt of higher fatty acid represented by zinc stearate, and fluorine-based polymer particles).

The amount of the external additive externally added is, for example, preferably from 0.01% by weight to 5% by weight, and more preferably from 0.01% by weight to 2.0% by weight with respect to the toner particles.

Preparing Method of Toner

Next, a method of preparing a toner according to this exemplary embodiment will be described.

The toner according to this exemplary embodiment is obtained by externally adding an external additive to toner particles after preparing of the toner particles.

The toner particles may be prepared using any of a dry method (e.g., kneading and pulverizing method) and a wet method (e.g., aggregation and coalescence method, suspension and polymerization method, and dissolution and suspension method). The toner particle preparing method is not particularly limited to these methods, and a known method is employed. Particularly, when employing the wet method, the toner particles can be granulated in a temperature range lower than 100° C., and accordingly, for example, the reaction between the aromatic aldehyde compound and the resin component is prevented in the preparing of the toner particles. Among these, the toner particles are preferably obtained by an aggregation and coalescence method which can exhibit more effects, by containing a small amount of the aromatic aldehyde compound.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Here, the aromatic aldehyde compound described above is preferably added separately from the polyester resin. The aromatic aldehyde compound may be added in any process of a dispersion preparation process of a toner constituent element other than the polyester resin, an aggregated particle forming process, and a coalescence process. When preparing toner particles having a core/shell structure which will be described later, the aromatic aldehyde compound may be added to any dispersion of aggregated particle dispersion, resin particle dispersion in which the resin particles are dispersed, and mixed dispersion of the aggregated particle dispersion and the resin particle dispersion in which the resin particles are dispersed. The aromatic aldehyde compound preferably exists on the surface of the polyester resin, in order to prevent the deterioration of anti-crease performance of the halftone image. From this viewpoint, the aromatic aldehyde compound is preferably added before or after the dispersion preparation process of a toner constituent element other than the polyester resin. In addition, the aromatic aldehyde compound may be put into the toner particles by a method of performing an additional stirring process for slurry liquid after preparing the toner particles.

Hereinafter, the respective processes will be described in detail.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

Herein, the resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohol. These may be used alone or in combination of two or more kinds thereof.

Examples of the surfactant include anionic surfactants such as sulfuric ester salt-based, sulfonate-based, phosphate-based, and soap-based anionic surfactants; cationic surfactants such as amine salt-based and quaternary ammonium salt-based cationic surfactants; and nonionic surfactants such as polyethylene glycol-based, alkyl phenol ethylene oxide adduct-based, and polyol-based nonionic surfactants. Among these, anionic surfactants and cationic surfactants are particularly used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding abase to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, LA-700 manufactured by Horiba, Ltd.), and a particle diameter when the cumulative percentage becomes 50% with respect to the entirety of the particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Aggregated Particle Forming Process

Next, the colorant particle dispersion and the release agent particle dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to be acidic (for example, the pH is from 2 to 5), a dispersion stabilizer may be added if necessary, and the heating may then be performed.

Examples of the aggregating agent include a surfactant having an opposite polarity to the polarity of the surfactant used as the dispersing agent to be added to the mixed dispersion, such as inorganic metal salts and di- or higher-valent metal complexes. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate, and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

The amount of the chelating agent added is, for example, preferably from 0.01 part by weight to 5.0 parts by weight, and more preferably from 0.1 part by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to this exemplary embodiment is prepared by, for example, adding and mixing an external additive with dry toner particles that have been obtained. The mixing is preferably performed with, for example, a V-blender, a Henschel mixer, a Lodige mixer, or the like. Furthermore, if necessary, coarse toner particles may be removed using a vibration sieving machine, a wind classifier, or the like.

Next, the kneading and pulverizing method will be described.

The kneading and pulverizing method is a method of mixing the toner forming materials such as the binder resin and then melting and kneading the material using a kneader and an extruder, performing coarse pulverizing of the obtained melted and kneaded material, and then performing pulverization using a jet mill, and obtaining toner particles having a particle diameter in a target range by a wind classifier.

Kneading Process

In the kneading process, the toner forming materials containing the binder resin are kneaded. Examples of a kneading machine used in the kneading process include a single screw extruder, a twin screw extruder, and the like. Hereinafter, a kneading machine including a sending screw portion and two kneading portions will be described as an example of the kneading machine with reference to the drawing, but it is not limited thereto.

Figure 3:
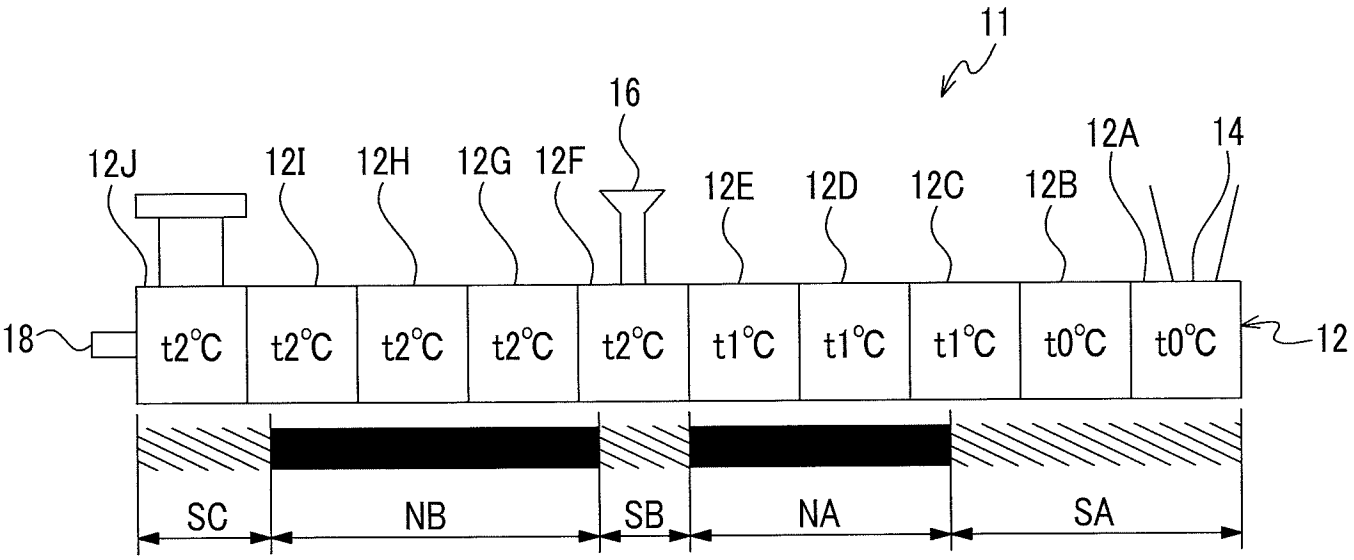
FIG. 3 is a diagram illustrating a screw state of an example of a screw extruder used for preparing toner according to this exemplary embodiment.

FIG. 3 is a diagram illustrating a screw state of an example of a screw extruder that is used in the kneading process of the method of preparing the toner according to this exemplary embodiment.

A screw extruder 11 is constituted by a barrel 12 provided with a screw (not shown), an injection port 14 through which a toner forming material that is a raw material of the toner is injected to the barrel 12, a liquid addition port 16 for adding an aqueous medium to the toner forming material in the barrel 12, and a discharge port 18 through which the kneaded material formed by kneading the toner forming material in the barrel 12 is discharged.

In order from a portion close to the injection port 14, the barrel 12 is divided into a sending screw portion SA which transports the toner forming material which is injected from the injection port 14 to a kneading portion NA, the kneading portion for melting and kneading the toner forming material by a first kneading process, a sending screw portion SB which transports the toner forming material which is melted and kneaded in the kneading portion NA to a kneading portion NB, the kneading portion NB which is for melting and kneading the toner forming material by a second kneading process to form a kneaded material, and a sending screw portion SC which transports the formed kneaded material to the discharge port 18.

In addition, in the barrel 12, a different temperature controller (not shown) is provided for each block. That is, the temperatures of blocks 12A to 12J may be controlled to be different from each other. FIG. 3 shows a state in which the temperatures of the blocks 12A and 12B are controlled to t0° C., the temperatures of the blocks 12C to 12E are controlled to t1° C., and the temperatures of the blocks 12F to 12J are controlled to t2° C. Therefore, the toner forming material in the kneading portion NA is heated to t1° C., and the toner forming material in the kneading portion NB is heated to t2° C.

When the toner forming material containing a binder resin, a release agent and the like is supplied to the barrel 12 from the injection port 14, the sending screw portion SA sends the toner forming material to the kneading portion NA. At this time, since the temperature of the block 12C is set to t1° C., the toner forming material melted by heating is fed to the kneading portion NA. In addition, since the temperatures of the blocks 12D and 12E are also set to t1° C., the toner forming material is melted and kneaded at a temperature of t1° C. in the kneading portion NA. The binder resin and the release agent are melted in the kneading portion NA and subjected to shearing with the screw.

Next, the toner forming material kneaded in the kneading portion NA is sent to the kneading portion NB by the sending screw portion SB.

In the sending screw portion SB, an aqueous medium is added to the toner forming material by injecting the aqueous medium to the barrel 12 from the liquid addition port 16. In FIG. 3, the aqueous medium is injected in the sending screw portion SB, but the invention is not limited thereto. The aqueous medium may be injected in the kneading portion NB, or may be injected in both of the sending screw portion SB and the kneading portion NB. That is, the position at which the aqueous medium is injected and the number of injection positions are selected as necessary.

As described above, due to the injection of the aqueous medium to the barrel 12 from the liquid addition port 16, the toner forming material in the barrel 12 and the aqueous medium are mixed, and the toner forming material is cooled by evaporative latent heat of the aqueous medium, whereby the temperature of the toner forming material is maintained.

Finally, the kneaded material formed by being melted and kneaded by the kneading portion NB is transported to the discharge port 18 by the sending screw portion SC, and is discharged from the discharge port 18.

By doing so, the kneading process using the screw extruder 11 shown in FIG. 3 is performed.

Cooling Process

The cooling process is a process of cooling the kneaded material which is formed in the kneading process, and in the cooling process, it is preferable to cool the kneaded material to 40° C. or lower from a temperature of the kneaded material at the time of completing the kneading process, at an average temperature falling rate of 4° C./sec or more. When the cooling rate of the kneaded material is slow, the mixture which is finely dispersed in the binder resin in the kneading process may be recrystallized and a dispersion diameter may become large. Meanwhile, it is preferable to perform rapid cooling at the average temperature falling rate, since the dispersed state immediately after completion of the kneading process is maintained as it is. The average temperature falling rate is an average value of a rate of the temperature falling from the temperature (for example, t2° C. when using the screw extruder 11 of FIG. 3) of the kneaded material at the time of completing the kneading process to 40° C.

In detail, as a cooling method of the cooling process, a method of using a rolling roll in which cold water or brine is circulated and an insert type cooling belt is used. When performing the cooling using the method described above, a cooling rate thereof is determined by a rate of the rolling roll, a flow rate of the brine, a supplied amount of the kneaded material, a slab thickness at the time of rolling the kneaded material, and the like. The slab thickness is preferably from 1 mm to 3 mm.

Pulverization Process

The kneaded material cooled through the cooling process is pulverized through the pulverization process to form toner particles. In the pulverization process, for example, a mechanical pulverizer, a jet pulverizer or the like is used.

Classification Process

If necessary, the toner particles obtained through the pulverization process may be classified through a classification process in order to obtain toner particles having a volume average particle diameter in a target range. In the classification process, a centrifugal classifier, an inertia-type classifier or the like, that have been used in the past, is used, and fine particles (toner particles having a particle diameter smaller than the target range) and coarse particles (toner particles having a particle diameter larger than the target range) are removed.

The toner particles are obtained with the processes described above.

Electrostatic Charge Image Developer

An electrostatic charge image developer according to this exemplary embodiment includes at least the toner according to this exemplary embodiment.

The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a coating resin; a magnetic powder dispersion-type carrier in which a magnetic powder is dispersed and blended in a matrix resin; and a resin impregnation-type carrier in which a porous magnetic powder is impregnated with a resin.

The magnetic powder dispersion-type carrier and the resin impregnation-type carrier may be carriers in which constituent particles of the carrier are cores and have a surface coated with a coating resin.

In the electrostatic charge image developer according to this exemplary embodiment, the carrier is preferably a resin coated carrier and contains conductive powder such as carbon black in the resin.

Examples of the magnetic powder include magnetic metals such as iron, nickel, and cobalt, and magnetic oxides such as ferrite and magnetite.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin.

The coating resin and the matrix resin may contain additives such as a conductive material.

Herein, a coating method using a coating layer forming solution in which a coating resin and, if necessary, various additives are dissolved in an appropriate solvent is used to coat the surface of a core with the coating resin. The solvent is not particularly limited, and may be selected in consideration of the type of coating resin to be used, coating suitability, and the like.

Specific examples of the resin coating method include a dipping method of dipping cores in a coating layer forming solution; a spraying method of spraying a coating layer forming solution to surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on a charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case where the image forming apparatus according to this exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachably attached to the image forming apparatus. As the process cartridge, for example, a process cartridge that contains the electrostatic charge image developer according to this exemplary embodiment and is provided with a developing unit is preferably used.

Hereinafter, an example of the image forming apparatus according to this exemplary embodiment will be described. However, the image forming apparatus is not limited thereto. The major parts shown in the drawing will be described, but descriptions of other parts will be omitted.

FIG. 1 is a schematic configuration diagram showing the image forming apparatus according to this exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner contained in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described herein. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying laser beams 3Y to the photosensitive layer so that the specific resistance of the irradiated part is lowered to cause charges to flow on the surface of the photoreceptor 1Y, while charges stay on a part to which the laser beams 3Y are not applied.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y contains, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the latent image part having been erased on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

Meanwhile, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet and the like are also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, and descriptions of other parts will be omitted.

Figure 2:
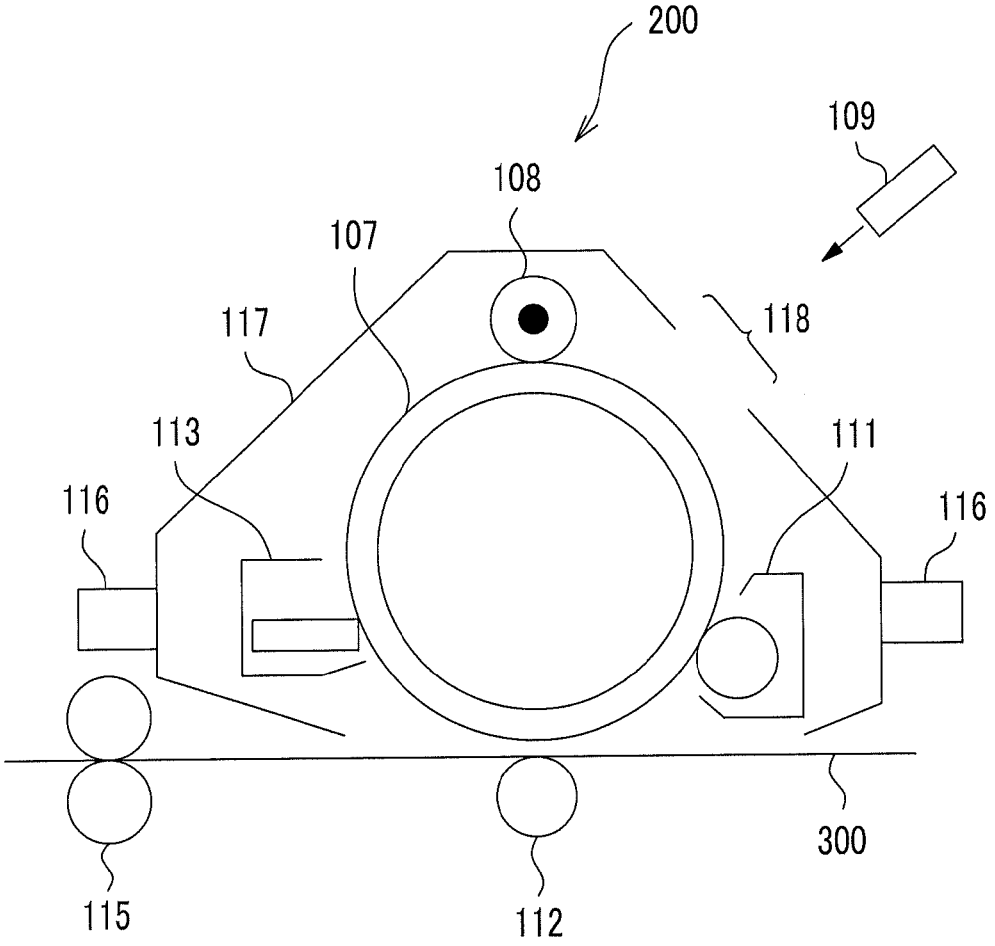
FIG. 2 is a schematic configuration diagram showing an example of a process cartridge according to this exemplary embodiment.

FIG. 2 is a schematic diagram showing a configuration of the process cartridge according to this exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, when the toner accommodated in the toner cartridge runs low, the toner cartridge is replaced.

EXAMPLES

Hereinafter, this exemplary embodiment will be described in detail using examples, but is not limited to these examples. In the following description, unless otherwise noted, "part(s)" and "%" are based on weight.

Preparation of Polyester Resin Particle Dispersion

Propylene oxide adduct of bisphenol A: 100 parts by weight

Terephthalic acid: 70 parts by weight

Dodecenyl succinic acid: 22 parts by weight

Trimellitic acid anhydride: 3 parts by weight

The monomer described above except for trimellitic acid anhydride, and 0.17 part by weight of dioctanoic acid tin with respect to 100 parts by weight of monomer components are put in a reaction vessel including a stirrer, a thermometer, a capacitor, and a nitrogen gas introducing tube. Under the nitrogen gas flow, the mixture is subjected to a reaction at 235° C. for 6 hours and is cooled to 190° C., and trimellitic acid anhydride is added thereto and subjected to a reaction for 1 hour. The mixture is further heated to 220° C. for 4 hours, and is polymerized under a pressure of 10 kPa until a desirable molecular weight is obtained. As a result, a polyester resin having a glass transition temperature Tg of 57° C. and a weight average molecular weight Mw of 65,000 is obtained.

Next, an amount of a mixed solvent of ethyl acetate and isopropyl alcohol in which the resin can be dissolved, is put in a 5 L separable flask, the resin described above is slowly put therein, the mixture is stirred by using a three-one motor and is dissolved to obtain an oil phase. An appropriate amount of diluted ammonia aqueous solution is added dropwise to the oil phase being stirred, ion exchange water is further added dropwise to the mixture to perform phase inversion emulsification, solvent thereof is removed while reducing the pressure with an evaporator, and polyester resin dispersion is obtained. The volume average particle diameter of the resin particles in this dispersion is 160 nm. After that, the adjustment is performed with the ion exchange water and solid content concentration is set to 20% by weight.

Preparation of Colorant Particle Dispersion

Carbon black pigment (Nipex 35 manufactured by Evonik Degussa Japan. Co., Ltd.): 70 parts by weight Nonionic surfactant: 5 parts by weight (NONIPOL 400 manufactured by Sanyo Chemical Industries, Ltd.)

Ion exchange water: 220 parts by weight

The above components are mixed with and dissolved in each other, and are dispersed for 10 minutes using a homogenizer (Ultra Turrax T50 manufactured by IKA Japan, K.K.), and colorant particle dispersion (1) in which colorant (carbon black pigment) particles having a volume average particle diameter D50v of 210 nm and solid content of 20% by weight are dispersed, is prepared.

Preparation of Release Agent Particle Dispersion

Hydrocarbon-based wax: 50 parts by weight (POLYWAX 725, manufactured by Baker Hughes Incorporated)

Anionic surfactant: 2.5 parts by weight (NEOGEN RK manufactured by Dai-Ichi Kogyo Seiyaku Co., Ltd.: active ingredient amount: 60%, 3.0% of active ingredient with respect to the release agent)

Ion exchange water: 170 parts by weight

The above components are heated to 120° C., dispersed for 10 minutes using a homogenizer (Ultra Turrax T50 manufactured by IKA Japan, K.K.) in a stainless-steel round flask, and then are subjected to a dispersion treatment using a pressure discharge type homogenizer, and release agent particle dispersion in which release agent particles having a volume average particle diameter D50v of 215 nm and solid content of 30% by weight are dispersed, is prepared.

Example 1

Preparation of Toner (1)

Polyester resin particle dispersion: 325 parts by weight

Colorant particle dispersion: 30 parts by weight

Release agent particle dispersion: 20 parts by weight

Benzaldehyde (manufactured by Wako Pure Chemical Industries, Ltd.): 0.091 part by weight The above components are mixed and dispersed in a stainless-steel round flask using a homogenizer (Ultra Turrax T50 manufactured by IKA Japan, K.K.), and heated to 50° C. while stirring the inside of the flask in a heating oil bath. It is kept at 45° C. for 20 minutes. The formation of aggregated particles having an average particle diameter of approximately 5.8 μm at that time is confirmed. 120 parts by weight of the polyester resin particle dispersion is gently added to the mixed liquid described above. Then, it is kept for 30 minutes after increasing the temperature of the heating oil bath to 50° C. The formation of aggregated particles having an average particle diameter of approximately 6.4 μm is confirmed.

After adding 3 parts by weight of the anionic surfactant (NEOGEN SC manufactured by Dai-Ichi Kogyo Seiyaku Co., Ltd.) to the mixed liquid described above, the stainless-steel flask is sealed, and the mixed liquid is heated to 98° C. while stirring using a magnetic seal, and held for 4 hours. After cooling, a reaction product is filtrated, sufficiently washed with the ion exchange water, and dried, and thus toner particles (1) having a shape factor of 120.5 and D50v of 6.4 μM are obtained.

After that, 3.3 parts by weight of hydrophobic silica particles (RY50 manufactured by Aerosil Nippon Co., Ltd.)

is added to 100 parts by weight of the toner particles (1), as an external additive. Then, the resultant material is mixed at a peripheral speed of 30 m/s for 3 minutes, using a Henschel mixer. Next, the resultant material is sieved with a vibration sieving machine having mesh of 45 μm, and toner (1) is obtained.

Example 2

Preparation of Toner (2)

Toner (2) is obtained by preparing toner particles in the same manner as in Example 1, except for changing the amount of benzaldehyde to 0.083 part by weight.

Example 3

Preparation of Toner (3)

Toner (3) is obtained by preparing toner particles in the same manner as in Example 1, except for changing the amount of benzaldehyde to 0.187 part by weight.

Example 4

Preparation of Toner (4)

Toner (4) is obtained by preparing toner particles in the same manner as in Example 1, except for changing the amount of benzaldehyde to 0.079 part by weight.

Example 5

Preparation of Toner (5)

Toner (5) is obtained by preparing toner particles in the same manner as in Example 1, except for changing the amount of benzaldehyde to 0.068 part by weight.

Example 6

Preparation of Toner (6)

Toner (6) is obtained by preparing toner particles in the same manner as in Example 1, except for changing the amount of benzaldehyde to 0.199 part by weight.

Example 7

Preparation of Toner (7)

Toner (7) is obtained by preparing toner particles in the same manner as in Example 1, except for changing the amount of benzaldehyde to 0.287 part by weight.

Example 8

Preparation of Toner (8)

Toner (8) is obtained by preparing toner particles in the same manner as in Example 1, except for changing the amount of benzaldehyde to 0.063 part by weight.

Example 9

Preparation of Toner (9)

Toner (9) is obtained by preparing toner particles in the same manner as in Example 1, except for changing the amount of benzaldehyde to 0.043 part by weight.

Example 10

Preparation of Toner (10)

Toner (10) is obtained by preparing toner particles in the same manner as in Example 1, except for changing the amount of benzaldehyde to 0.301 part by weight.

Example 11

Preparation of Toner (11)

Toner (11) is obtained by preparing toner particles in the same manner as in Example 1, except for changing the amount of benzaldehyde to 0.572 part by weight.

Comparative Example 1

Preparation of Toner (12)

Toner (12) is obtained by preparing toner particles in the same manner as in Example 1, except for changing the amount of benzaldehyde to 0.037 part by weight.

Comparative Example 2

Preparation of Toner (13)

Toner (13) is obtained by preparing toner particles in the same manner as in Example 1, except for changing the amount of benzaldehyde to 0.632 part by weight.

Example 12

Preparation of Toner (14)

Polyester resin (polyester resin which uses 2 mol adduct of propylene oxide and 2 mol adduct of ethylene oxide of bisphenol A, terephthalic acid, trimellitic acid as main components and is synthesized by using a tin catalyst): 130 parts by weight Carbon black pigment (Nipex 35 manufactured by Evonik Degussa Japan. Co., Ltd.): 12 parts by weight Hydrocarbon-based wax (POLYWAX 725, manufactured by Baker Hughes Incorporated): 12 parts by weight Benzaldehyde: 0.1 part by weight The above components are mixed with each other by a Henschel mixer, and then kneading is performed under the following conditions, by using a continuous kneader (twin screw extruder) having a screw configuration shown in FIG. 3. A rotating speed of the screw is set to 500 rpm.

Feed portion (blocks 12A and 12B) setting temperature: 20° C.

Kneading portion 1 kneading setting temperature (blocks 12C to 12E): 100° C.

Kneading portion 2 kneading setting temperature (blocks 12F to 12J): 110° C.

Added amount of aqueous medium (distilled water) (with respect to 100 parts of raw material supply amount): 1.5 parts A kneaded material temperature at the discharge port (discharge port 18) at this time is 120° C.

This kneaded material is rapidly cooled with a rolling roll in which brine at −5° C. is circulated and a slab insert type cooling belt that performs cooling with cold water at 2° C., and after the cooling, the material is crushed with a hammer mill. The rapid cooling rate is confirmed by changing the speed of the cooling belt. An average temperature falling rate thereof is 10° C./sec.

After that, the material is pulverized with a pulverizer with coarse powder classifier embedded therein (AFG400) to obtain pulverized particles. Then, classification is performed with an inertia-type classifier to remove fine particles and coarse particles, and toner particles (14) having a volume average particle diameter of 7.2 μm are obtained.

Toner (14) is obtained by preparing toner in the same manner as in Example 1, except for changing the toner particles to the toner particles (14).

Example 13

Preparation of Toner (15)

Toner (15) is obtained by preparing toner particles in the same manner as in Example 1, except for changing benzaldehyde to 4-methoxy-2-(trifluoromethyl) benzaldehyde (manufactured by Wako Pure Chemical Industries, Ltd.).

Example 14

Preparation of Toner (16)

Toner (16) is obtained by preparing toner particles in the same manner as in Example 1, except for changing benzaldehyde to 2-methoxy benzaldehyde (manufactured by Wako Pure Chemical Industries, Ltd.).

Example 15

Preparation of Toner (17)

Toner (17) is obtained by preparing toner particles in the same manner as in Example 1, except for changing benzaldehyde to 2-phenyl propanal (manufactured by Wako Pure Chemical Industries, Ltd.).

Example 16

Styrene Acrylic Resin Particle Dispersion

Styrene: 306 parts by weight
n-butyl acrylate: 94 parts by weight
Acrylic acid: 0.2 part by weight
10-dodecanethiol: 1.5 parts by weight A resultant material obtained by mixing and dissolving the above components is added to a solution obtained by dissolving 6 parts by weight of a nonionic surfactant (NONIPOL 400 manufactured by Sanyo Chemical Industries, Ltd.) and 10 parts by weight of an anionic surfactant (NEOGEN SC manufactured by Dai-Ichi Kogyo Seiyaku Co., Ltd.) in 550 parts by weight of ion exchange water, and the mixture is emulsified and dispersed in a flask, and gently mixed for 10 minutes, and 50 parts by weight of ion exchange water in which 4 parts by weight of ammonium persulfate is dissolved is put thereto. Next, after performing nitrogen substitution, the solution is heated in an oil bath to be 70° C. while stirring the solution in the flask, and emulsification and polymerization is continued for 5 hours. As a result, resin particle dispersion in which styrene acrylic resin particles having a volume average particle diameter D50v of 104 nm, a glass transition temperature Tg of 58° C., and a weight average molecular weight Mw of 57,000 are dispersed is obtained.

Preparation of Toner (18)

Toner (18) is obtained by preparing toner particles in the same manner as in Example 1, except for changing the amount of the polyester resin particle dispersion to 225 parts by weight and further adding 60 parts by weight of the styrene acrylic resin particle dispersion.

Preparation of Developer

Preparation of Carrier (A)

Ferrite particles (volume average particle diameter: 50 μm): 100 parts by weight
Toluene: 100 parts by weight 15 parts by weight
Styrene-methyl methacrylate copolymer (component molar ratio: 90/10, weight average molecular weight Mw of 80000): 2 parts by weight
Carbon black (R330 manufactured by Cabot Corporation): 0.25 part by weight First, a coating solution is prepared by stirring and dispersing the above components excluding the ferrite particles with a stirrer for 10 minutes. Then, this coating solution and the ferrite particles are put into a vacuum deaeration kneader and stirred at 60° C. for 25 minutes, then the pressure is reduced while heating, and deaeration and drying are performed to prepare a carrier (A). Regarding this carrier (A), a shape factor is 120, a true specific gravity is 4.4, saturated magnetization is 63 emu/g, and a specific volume resistivity value in an applied electric field of 1000 V/cm is 1000 Ω·cm.

Regarding the toner (1) to the toner (18) obtained in each example, 8 parts by weight of the toner and 92 parts by weight of the carrier (A) are put into a V-blender, stirred for 20 minutes, and sieved with mesh of 105 μm, and developers (1) to (18) are prepared.

Evaluation of Anti-Crease Performance of Image (Crease Evaluation)

Each developer is accommodated in a developing device of a modified machine of a DocuCentre Color 500 (modified to perform fixing with an external fixing machine with a variable fixing temperature) manufactured by Fuji Xerox Co., Ltd. A halftone image with a toner amount of 1 g/m$^2$ is formed on the color paper (J paper) manufactured by Fuji Xerox Co., Ltd. by using this modifier. After forming a toner image, the image is fixed at a fixing temperature of 180° C. and a fixing speed of 180 mm/sec by using an external fixing machine.

Next, the fixed image is kept under a white lamp with high light intensity (1 kW/m$^2$) for 20 days in the environment of 25° C. and 85% RH to perform a deterioration process. The center of the processed fixed image is folded inwards, the broken part of the fixed image is wiped, and then, a white line width is measured and a maximum value is evaluated with the following evaluation criteria. G2 and higher levels are acceptable levels.

G4: The maximum value of the white line width is smaller than 0.1 mm.

G3: The white line width is equal to or greater than 0.1 mm and smaller than 0.3 mm.

G2: The white line width is equal to or greater than 0.3 mm and smaller than 0.5 mm.

G1: The white line width is equal to or greater than 0.5 mm.

TABLE 1

| | Toner | Binder resin | | Aromatic aldehyde compound | | | |
|---|---|---|---|---|---|---|---|
| | no. | Kind | Blended amount (% by weight) | Kind | Content (ppm) | Toner preparation method | Evaluation |
| Ex. 1 | 1 | Polyester | 100 | Benzaldehyde | 200 | Aggregation and coalescence method | G4 |
| Ex. 2 | 2 | Polyester | 100 | Benzaldehyde | 186 | Aggregation and coalescence method | G4 |
| Ex. 3 | 3 | Polyester | 100 | Benzaldehyde | 390 | Aggregation and coalescence method | G4 |
| Ex. 4 | 4 | Polyester | 100 | Benzaldehyde | 177 | Aggregation and coalescence method | G3 |
| Ex. 5 | 5 | Polyester | 100 | Benzaldehyde | 156 | Aggregation and coalescence method | G3 |
| Ex. 6 | 6 | Polyester | 100 | Benzaldehyde | 415 | Aggregation and coalescence method | G3 |
| Ex. 7 | 7 | Polyester | 100 | Benzaldehyde | 588 | Aggregation and coalescence method | G3 |
| Ex. 8 | 8 | Polyester | 100 | Benzaldehyde | 145 | Aggregation and coalescence method | G2 |
| Ex. 9 | 9 | Polyester | 100 | Benzaldehyde | 106 | Aggregation and coalescence method | G2 |
| Ex. 10 | 10 | Polyester | 100 | Benzaldehyde | 615 | Aggregation and coalescence method | G2 |
| Ex. 11 | 11 | Polyester | 100 | Benzaldehyde | 1150 | Aggregation and coalescence method | G2 |
| Ex. 12 | 14 | Polyester | 100 | Benzaldehyde | 192 | Kneading and pulverizing method | G3 |
| Ex. 13 | 15 | Polyester | 100 | 4-methoxy-2-(trifluoromethyl) benzaldehyde | 205 | Aggregation and coalescence method | G3 |
| Ex. 14 | 16 | Polyester | 100 | 2-methoxy benzaldehyde | 216 | Aggregation and coalescence method | G3 |
| Ex. 15 | 17 | Polyester | 100 | 2-phenyl propanal | 185 | Aggregation and coalescence method | G2 |
| Ex. 16 | 18 | Polyester<br>Styrene acryl | 80<br>20 | Benzaldehyde | 203 | Aggregation and coalescence method | G4 |
| Com. Ex. 1 | 12 | Polyester | 100 | Benzaldehyde | 95 | Aggregation and coalescence method | G1 |
| Com. Ex. 2 | 13 | Polyester | 100 | Benzaldehyde | 1270 | Aggregation and coalescence method | G1 |

From the results described above, it is found that results of the evaluation of the anti-crease performance of the halftone image of the examples are excellent, compared to the comparative examples. Therefore, it is found that, in the examples, the deterioration of the anti-crease performance of the halftone image after being kept in the environment of high humidity and high light intensity is prevented, compared to the comparative examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a binder resin containing a polyester resin;

a release agent;

a colorant; and an aromatic aldehyde compound, the content of which exceeds 100 ppm and is equal to or smaller than 1200 ppm, wherein the content of the aromatic aldehyde compound in the toner composition is externally adjusted, and wherein the aromatic aldehyde compound is at least one selected from the group consisting of benzaldehyde, 4-methoxy-2-(trifluoromethyl) benzaldehyde, 2-methoxy benzaldehyde, and 2-phenyl propanal.

2. The electrostatic charge image developing toner according to claim 1, wherein the aromatic aldehyde compound is benzaldehyde.

3. The electrostatic charge image developing toner according to claim 1, wherein a glass transition temperature (Tg) of the polyester resin is from 50° C. to 80° C.

4. The electrostatic charge image developing toner according to claim 1, wherein a weight average molecular weight (Mw) of the polyester resin is from 5,000 to 1,000,000.

5. The electrostatic charge image developing toner according to claim 1, wherein molecular weight distribution Mw/Mn of the polyester resin is from 1.5 to 100.

6. The electrostatic charge image developing toner according to claim 1, wherein a content of the colorant is from 1% by weight to 30% by weight with respect to the entirety of toner particles.

7. The electrostatic charge image developing toner according to claim 1, wherein a melting temperature of the release agent is from 50° C. to 110° C.

8. The electrostatic charge image developing toner according to claim 1, wherein a volume average particle diameter (D50v) is from 2 μm to 10 μm.

9. The electrostatic charge image developing toner according to claim 1, wherein a shape factor SF1 is from 110 to 150.

10. The electrostatic charge image developing toner according to claim 1, wherein the toner is granulated by a wet method in a temperature range lower than 100° C.

11. An electrostatic charge image developer comprising the electrostatic charge image developing toner according to claim 1 and a carrier.

12. The electrostatic charge image developer according to claim 11, wherein the carrier is a resin coated carrier and contains conductive powder in the resin.

13. The electrostatic charge image developer according to claim 12, wherein the conductive powder is carbon black.

14. A toner cartridge that accommodates the electrostatic charge image developing toner according to claim 1, and is detachable from an image forming apparatus.

15. The electrostatic charge image developing toner according to claim 1, wherein a melting temperature of the release agent is from 60° C. to 100° C.

* * * * *